US010258862B2

(12) United States Patent
Mohler et al.

(10) Patent No.: US 10,258,862 B2
(45) Date of Patent: Apr. 16, 2019

(54) SNOWBOARD

(71) Applicants: Tom Mohler, Tequesta, FL (US); Jonathan Mohler, Vero Beach, FL (US); Daniel Yates, Jacksonville, FL (US); Matthew Barus, Lake Worth, FL (US)

(72) Inventors: Tom Mohler, Tequesta, FL (US); Jonathan Mohler, Vero Beach, FL (US); Daniel Yates, Jacksonville, FL (US); Matthew Barus, Lake Worth, FL (US)

(73) Assignee: SPECTRE ENTERPRISES, INC., West Palm Beach, FL (US)

( * ) Notice: Subject to any disclaimer, the term of this patent is extended or adjusted under 35 U.S.C. 154(b) by 0 days.

(21) Appl. No.: 15/480,067

(22) Filed: Apr. 5, 2017

(65) Prior Publication Data

US 2018/0078845 A1 Mar. 22, 2018

Related U.S. Application Data

(60) Provisional application No. 62/318,754, filed on Apr. 5, 2016, provisional application No. 62/338,488, filed on May 18, 2016.

(51) Int. Cl.
*B62B 9/04* (2006.01)
*A63C 10/14* (2012.01)
(Continued)

(52) U.S. Cl.
CPC ..... *A63C 10/14* (2013.01); *A63C 5/03* (2013.01); *A63C 5/0417* (2013.01); *A63C 5/06* (2013.01); *A63C 10/18* (2013.01)

(58) Field of Classification Search
CPC ..... A63C 10/14; A63C 10/18; A63C 5/03; A63C 5/06; A63C 5/0417
See application file for complete search history.

(56) References Cited

U.S. PATENT DOCUMENTS 5,667,237 A * 9/1997 Lauer ..... A63C 10/18 280/14.24
5,669,630 A * 9/1997 Perkins ..... A43B 5/0403 280/14.24
(Continued)

FOREIGN PATENT DOCUMENTS

EP 0 761 261 3/1997

OTHER PUBLICATIONS

Snowboard, Wikipedia, http://en.wikipedia.org/wiki/Snowboard.
(Continued)

*Primary Examiner* — James M Dolak
(74) *Attorney, Agent, or Firm* — William F. Lang, IV; Lang Patent Law LLC

(57) ABSTRACT

A rotating binding for a snowboard or other recreational equipment to which a user's foot is attached includes a lever having teeth at one end for engaging corresponding teeth in a disk attached to the snowboard or other equipment. Movement of the lever is resisted until an additional movement of the lever is performed in order to unsecure the lever from a secured position in which it engages the teeth within the disk. Some examples of the snowboard or other recreational equipment may include retractable fins that may be extended downward from the snowboard, or secured in a retracted position.

6 Claims, 18 Drawing Sheets

(51) Int. Cl.

| | |
|---|---|
| ***A63C 5/03*** | (2006.01) |
| ***A63C 5/06*** | (2006.01) |
| ***A63C 10/18*** | (2012.01) |
| ***A63C 5/04*** | (2006.01) |

(56) References Cited

U.S. PATENT DOCUMENTS

| | | | | |
|---|---|---|---|---|
| 5,791,678 | A | 8/1998 | Perlman | |
| 5,816,603 | A | 10/1998 | Borsoi | |
| 5,876,045 | A | 3/1999 | Acuna, Jr. | |
| 5,947,488 | A | 9/1999 | Gorza | |
| 6,022,041 | A * | 2/2000 | Dailey | A63C 10/14 280/618 |
| 6,056,312 | A * | 5/2000 | Hogstedt | A63C 10/06 280/14.24 |
| 6,102,430 | A * | 8/2000 | Reynolds | A63C 10/18 280/618 |
| 6,318,749 | B1 | 11/2001 | Eglitis et al. | |
| 6,742,801 | B1 * | 6/2004 | Dodge | A63C 10/10 280/14.22 |
| 7,290,785 | B2 | 11/2007 | Dixon | |
| 7,837,219 | B1 * | 11/2010 | Cordes | A63C 10/18 280/14.24 |
| 8,371,591 | B2 * | 2/2013 | Hwongbo | A63C 10/18 280/14.24 |
| 9,072,959 | B2 * | 7/2015 | Bernal Bascunana | A63C 10/10 |
| 10,065,102 | B2 * | 9/2018 | Reguis | A63C 5/04 |
| 10,105,586 | B1 * | 10/2018 | Olsen-Lund | A63C 5/128 |
| 2002/0063404 | A1 | 5/2002 | Lafond | |

OTHER PUBLICATIONS

Everbilt Zinc Plated Gate Latch, The Home Deopt, http://www.homedepot.com/p/Everbilt-Zinc-Plated-Gate-Latch-15461/202042228.

How to Mount Bindings to a Snowboard, WikiHow, http://www.wikihow.com/Mount-Bindings-to-a-Snowboard.

Snowboard Bindings Installation, REI co-op, https://www.rei.com/learn/expert-advice/installing-snowboard-bindings.html.

International Search Report and Written Opinion for PCT/US17/26194, dated Jul. 6, 2017.

* cited by examiner

SNOWBOARD

CROSS REFERENCE TO RELATED APPLICATION

This application claims the benefit of U.S. provisional patent application Ser. No. 62/318,754, filed Apr. 5, 2016, and entitled "Rotation Device for Snowboard Binding," as well as U.S. provisional patent application Ser. No. 62/338,488, filed May 18, 2016, and entitled "Rotation Device for Snowboard Binding."

TECHNICAL FIELD

The present invention relates to snowboards. More specifically, a snowboard binding for securing a wearer's foot to the snowboard that permits selectively rotating the binding and securing the binding in a desired angular position is provided by some examples of the invention. Additionally, a retractable fin for a snowboard is provided by some examples of the invention.

BACKGROUND INFORMATION

Presently available snowboard bindings are intended to secure the users boot to the snowboard in the proper position for snowboarding, with both of the user's feet pointed towards one side of the snowboard. Although this foot position works well for snowboarding, it does not work well for attempting to walk with the snowboard before and after descending the slope. Although rotatable bindings are known, they are not necessarily user-friendly.

An example of a presently known snowboard binding is disclosed in U.S. Pat. No. 5,816,603, which was issued to B. Borsoi on Oct. 6, 1998. This patent discloses a snowboard binding having a circular plate that is rotatably secured to the base. No means of securing the base in a desired position with respect to the circular plate is disclosed.

U.S. Pat. No. 5,876,945, which was issued to P. R. Acuna, Jr. on Mar. 2, 1999, discloses an angularly adjustable snowboard boot mounting. The mounting includes a top disk fitting within a substantially circular upper cavity of the base of the binding. A base disk fits within a substantially circular lower cavity of the boot binding, and is mounted to the snowboard. The base disk includes raised ridges that engage complementary channels defined within the body of the binding. The bottom surface of the top disk and the wall of the upper cavity in the binding base also have complementary teeth that engage each other. The top disk, main body, and base disk or joined by a vertical shaft. A lever is provided at the top of the vertical shaft. A spring is positioned between the main body of the top disk, biasing the top disk and main body away from each other. Moving the lever from the open position to the closed position compresses the spring, causing the corresponding teeth in the top disk, bottom disk, and base to engage each other. When the lever is moved from the closed to the open position, a cam releases the tension in the vertical shaft, creating a gap between the upper surface of the top disk and the top lever. The angle of the main body with respect to the board can then be adjusted, and the top lever closed. The location of the top lever underneath the wearer's foot requires that the binding be removed from the wearer's foot in order to manipulate the lever.

U.S. Pat. No. 5,947,488, which was issued to R. Gorza et al. on Sep. 7, 1999, discloses an angular adjustment device for a snowboard binding. The device includes a disk having teeth about its periphery, and which is rigidly secured to the snowboard. The base of the binding is rotatably associated with the disk. The base includes a pair of pawls on each side of the disk, which are structured to engage the teeth of the disk, and which are spring biased towards the disk. An actuation ring surrounds the disk, and includes angled surfaces that are structured to interact with corresponding angled surfaces on the pawls, so that rotation of the actuation ring pushes the pawls out of engagement with the disk. Rotation of the actuation ring is controlled by a lever, with a gear operatively connected to the end of the lever's shaft. The gear interacts with teeth on the actuation ring to rotate the actuation ring upon activation of the lever. This device does not include a means of resisting accidental activation of the lever.

U.S. Pat. No. 7,290,785, which was issued to P. A. Dixon on Nov. 6, 2007, discloses an angular adjustment mechanism for snowboard bindings. The device includes an upper plate and upper gear coupling secured to the boot binding, and a lower retainer and lower gear coupling secured to the snowboard. A wave washer disposed above the upper gear coupling biases the upper gear coupling into engagement with the lower gear coupling, resisting rotation of the binding. The user can rotate the binding by raising their foot to bring the upper gear coupling and lower gear coupling out of engagement.

EP 0 761 261 discloses numerous variations of a rotating binding for a snowboard. The bindings include a disk that is rigidly connected to the snowboard, and a binding having a base that is rotatably connected to the disk. One example includes a pawl that is hingedly secured to the base, and includes teeth for engaging holes defined within the disk. As another alternative, a horizontally pivoting pawl may include one portion having a tooth that engages corresponding teeth defined at the edge of the disk, and a second portion that protrudes from the binding for manipulation by the user. This pawl is spring biased towards the disk. Yet another example includes a semicircular pawl having teeth defined along its concave edge, with this pawl being spring biased towards the disk. A rod connected to one end of the pawl protrudes from the base, and maybe pushed inward by the user to push the pawl away from the disk to rotate the binding. A lever may be provided at the end of this rod that is actuated by the user. A further example includes a worm gear that engages teeth around the edge of the disk, so that adjusting the angle of the binding is accomplished by rotating the worm gear. Yet another example includes teeth defined on the top surface of the disk, and a spring biased block having teeth on its bottom surface engaging the teeth on the disk. A lever having an eccentric element may be used to raise or lower the block, and to secure the block against the disk. As another variation of this embodiment, a push-button mechanism may be used to retract a spring biased engagement from the block. Some of these devices do not permit rotation of the binding without removing the user's foot. Other devices do not appear to provide significant resistance to accidental activation.

Accordingly, there is a need for a rotating binding for a snowboard that permits rotation of the binding without removing the user's foot from the binding. There is an additional need for a rotating binding for snowboard that resists unintentional rotation of the binding. There is a further need for a snowboard having retractable fins that may be extended below the snowboard when desired for walking with one's foot within the snowboard binding, thus facilitating walking by permitting desired movement of the snowboard while resisting undesired movement of the snowboard.

SUMMARY

The above needs are met by a rotatable binding assembly for a binding for a sliding recreational device. The sliding recreational device has a top surface and the binding has a base defining a bottom surface. The rotatable binding assembly comprises a disk having a periphery. The disk is secured to one of the top surface of the recreational device or the bottom surface of the base. The rotatable binding assembly further comprises a frame. The frame defines an aperture that is structured to receive the disk therein. The frame is secured to or forms a portion of the other of the top surface of the recreational device or the bottom surface of the base. The rotatable binding assembly additionally comprises a disk engagement member movably secured to the frame. The disk engagement member defines a disk engaging end that is structured to resist movement of the frame relative to the disk when the disk engaging end abuts the disk. The disk engagement member is movable between a first position wherein the disk engaging end abuts the disk, and a second position wherein the disk engaging end is separated from the disk. The rotatable binding assembly further includes an actuation member movably secured to the disk engagement member. The actuation member is movable between a first position wherein movement of the disk engaging member is resisted, and a second position wherein movement of the disk engagement member is permitted. The actuation member is further structured so that, when the actuation member is in its second position, movement of the disk engagement member towards or away from the disk is accomplished by moving the actuation member.

The binding may be rotated by grasping the actuation member, moving the actuation member in a first direction to permit movement of the disk engagement member, moving the actuation member in a second direction to move the disk engagement member away from the disk, and rotating the binding. Once the binding is in a desired rotational position, the actuation member is moved in a third direction to move the disk engagement member towards the disk, and the actuation member is then moved in a fourth direction to resist movement of the disk engagement member.

The above needs are further met by a retractable fin assembly for a sliding recreational device. The sliding recreational device has a top surface and a bottom surface. The retractable fin assembly comprises at least one fin movably mounted on the sliding recreational device. The fin is movable between an extended position wherein the fin extends below the bottom surface of the recreational device, and a retracted position wherein the fin does not extend below the bottom surface of the recreational device.

The above needs are also met by a sliding recreational device having a rotatable binding assembly as well as a retractable fin assembly. The sliding recreational device has a top surface and a bottom surface. The rotatable binding assembly comprises a disk having a periphery. The disk is secured to one of the top surface of the recreational device or the bottom surface of the base. The rotatable binding assembly also includes a frame. The frame defines an aperture that is structured to receive the disk therein. The frame is secured to or forms a portion of the other of the top surface of the recreational device or the bottom surface of the base. The rotatable binding assembly additionally comprises a disk engagement member movably secured to the frame. The disk engagement member defines a disk engaging end that is structured to resist movement of the frame relative to the disk when the disk engaging end abuts the disk. The disk engagement member is movable between a first position wherein the disk engaging end abuts the disk, and a second position wherein the disk engaging end is separated from the disk. The rotatable binding additionally includes an actuation member movably secured to the disk engagement member. The actuation member is movable between a first position wherein movement of the disk engaging member is resisted, and a second position wherein movement of the disk engagement member is permitted. The actuation member is further structured so that, when the actuation member is in its second position, movement of the disk engagement member towards or away from the disk is accomplished by moving the actuation member.

The binding may be rotated by grasping the actuation member, moving the actuation member in a first direction to permit movement of the disk engagement member, moving the actuation member in a second direction to move the disk engagement member away from the disk, and rotating the binding. Once the desired position is reached, the actuation member is moved in a third direction to move the disk engagement member towards the disk, and then the actuation member is moved in a fourth direction to resist movement of the disk engagement member.

The sliding recreational device also comprises a retractable fin assembly. The retractable fin assembly comprises at least one fin movably mounted on the sliding recreational device. The fin is movable between an extended position wherein the fin extends below the bottom surface of the recreational device, and a retracted position wherein the fin does not extend below the bottom surface of the recreational device.

These and other aspects of the invention will become more apparent through the following description and drawings.

DETAILED DESCRIPTION

Figure 1:
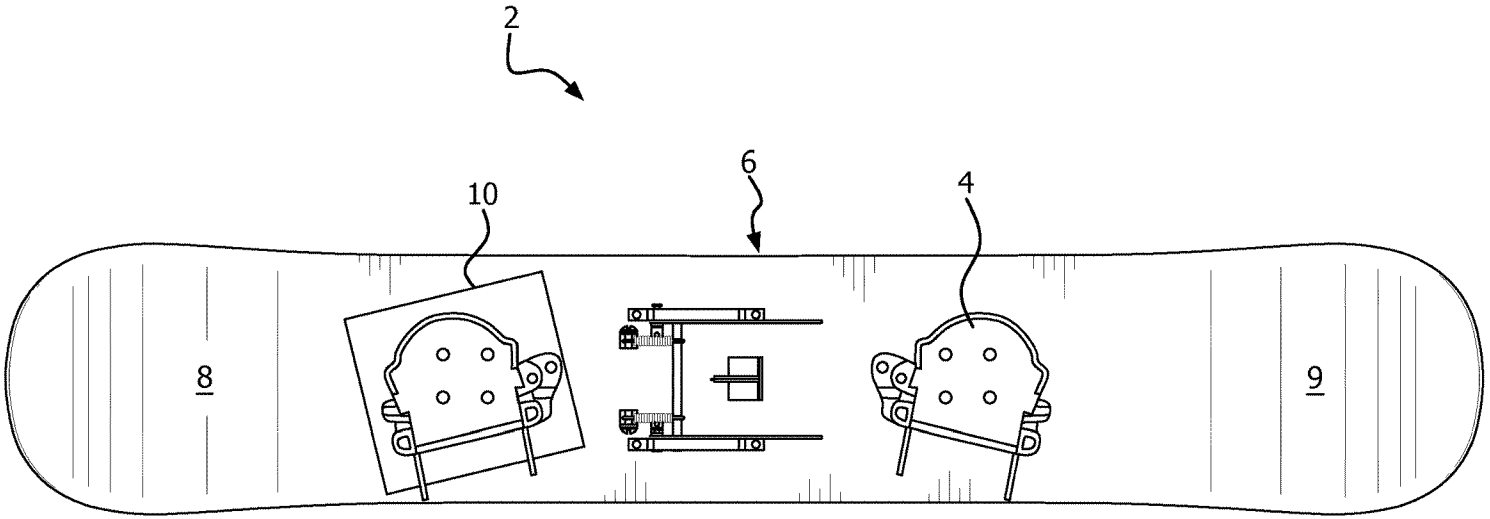
FIG. 1 is a top plan view of a snowboard including a rotatable binding and retractable fins.

Referring to the drawings, a rotation device for a binding for a sliding recreational device such as a snowboard. FIG. 1 illustrates a snowboard 2 incorporating a conventional binding 4, a rotating binding 10, and a retractable fin assembly 6. In the illustrated example, the rotating binding 10 is disposed in a forward portion 8 of the snowboard, and the conventional binding 4 is in a rear portion 9 of the snowboard. A rotatable binding 10 could alternatively be used in a rear portion 9 of the snowboard, or for both bindings, without departing from the invention.

Figure 2:
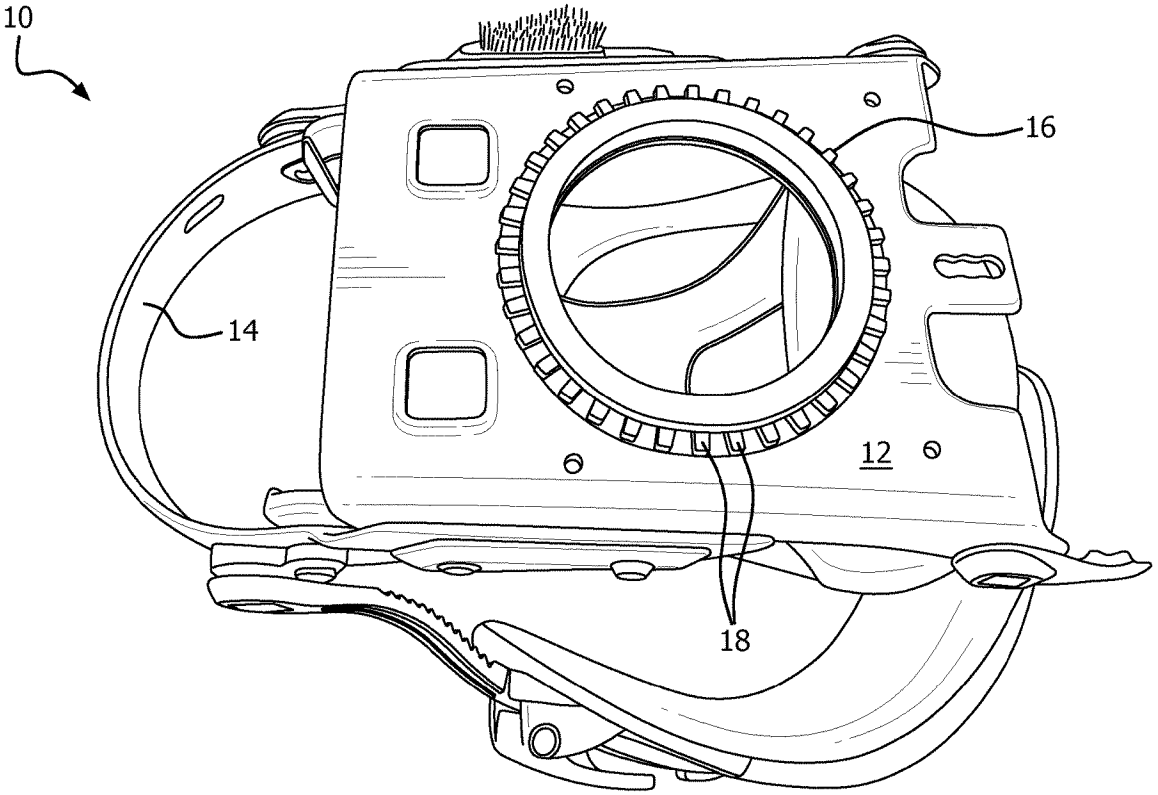
FIG. 2 is a perspective view of a snowboard binding having a gear of a rotation device for a snowboard binding attached.

FIG. 2 illustrates a rotating snowboard binding 10, having a binding mounting plate 12 having the conventional binding 14, including the straps, heel cup, etc., secured thereto in a manner that is well known in the art of snowboarding. The snowboard binding 10 differs from a conventional snowboard binding by having a rotation facilitating wheel, which in the illustrated example is in the form of a gear 16 having a plurality of outwardly facing teeth 18 distributed around at least a portion of the outer circumference of the gear 16.

Figure 3:
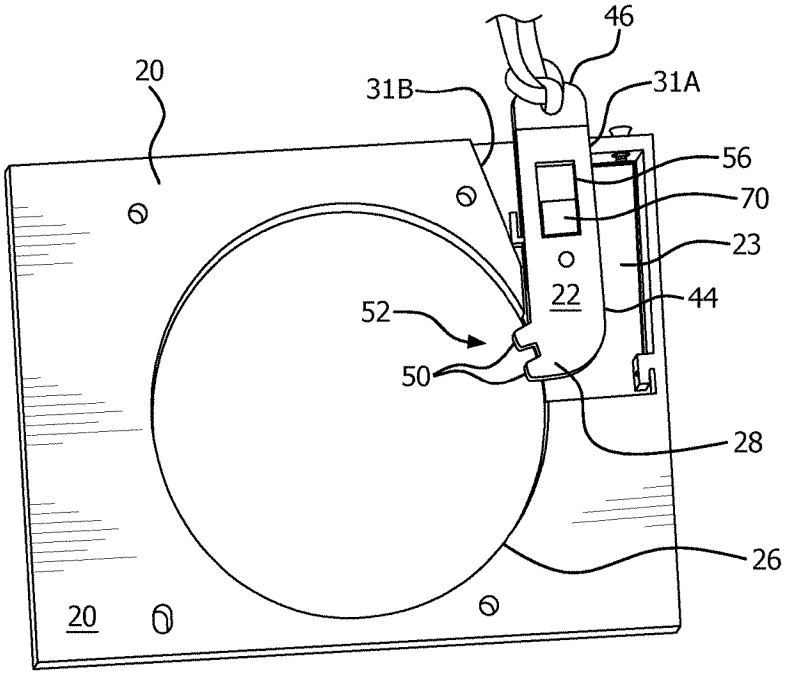
FIG. 3 is a top plan view of a base plate and lever for a rotation device for a snowboard binding.

Referring to FIG. 3, a base plate 20 and lever 22 for the rotation device 24 are illustrated. As will be explained in greater detail below, the gear 16 rotates within the generally circular cutout or opening 26 defined within the base plate 20, and is engaged by the gear engaging end 28 of the lever 22 to resist rotation at times when rotation is not desired.

Figure 4:
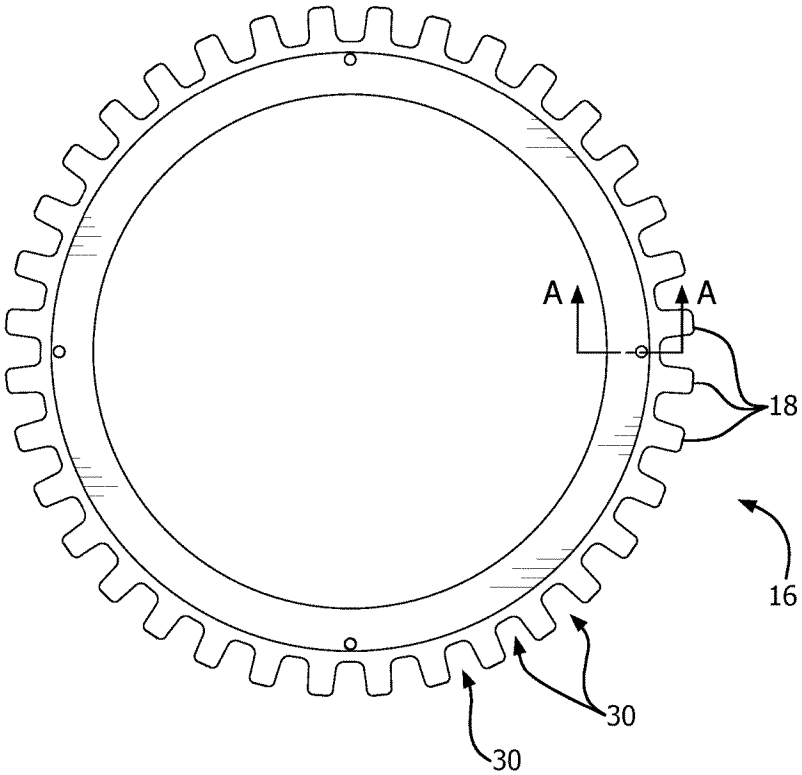
FIG. 4 is a top plan view of a gear for a rotation device for a snowboard binding.

The gear 16 is best illustrated in FIG. 4. In the illustrated example of the gear 16, the gear 16 is generally circular, and the teeth 18 are disposed around at least a fourth of the gear 16. In the illustrated example, the teeth 18 are disposed around the entire circumference of the gear 16. Spaces 30 are defined between each of the teeth 18. Other examples of the gear 16 may include an outer surface that defines only a portion of a complete circle, for example, half of the circle, or a fourth of a circle. Although the illustrated example of the teeth 18 are generally rectangular, other shapes, such as triangular or trapezoidal teeth, may be used. Other means of engaging a rotation resisting device such as inwardly protruding holes, or an outer surface having a high coefficient of friction, may also be utilized. Although the illustrated example of a gear 16 includes a hollow interior for use with presently available binding mounting hardware for bindings including a corresponding hole as described below, a different interior may be utilized without departing from the invention.

Figure 5:
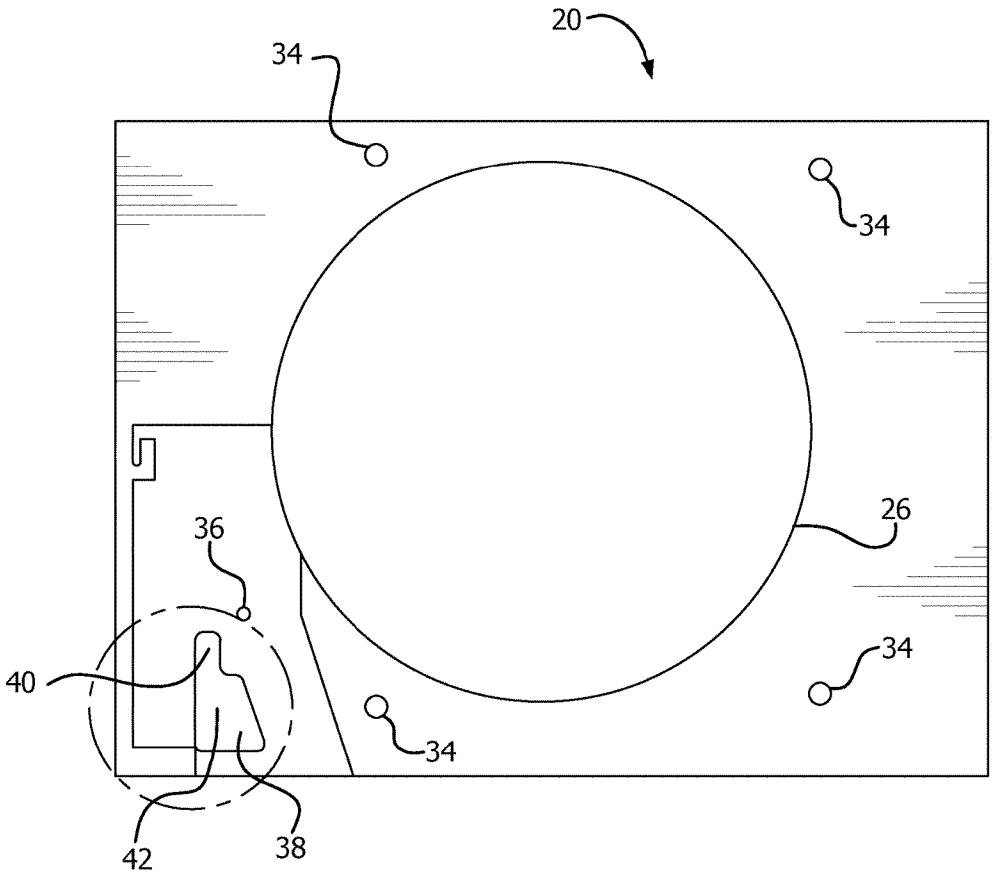
FIG. 5 is a top plan view of a base plate for a rotation device for a snowboard binding.

The base plate 20 is best illustrated in FIG. 5. The illustrated example of a base plate 20 is generally rectangular, defining a generally circular cutout or opening 26 that is generally centrally located within the base plate 20. Structures for mounting the base plate 20 to a snowboard are provided, and in the illustrated example includes the apertures 34 that are generally disposed in proximity to the four corners of the base plate 20, permitting the passage of screws or other mounting hardware therethrough. A pivotal attachment for a lever is provided, and in the illustrated example includes the aperture 36. A channel 38 is provided in proximity to the aperture 36. In the illustrated example, the channel 38 includes a smaller, generally rectangular portion 40 that is closest to the aperture 36, and a larger, generally trapezoidal portion 42 that is spaced a greater distance from the aperture 36. The illustrated example of the base plate 20 also defines a cutout portion 23 within which the lever 22 is mounted, defining stops 31A, 31B, corresponding to the gear-engaging and gear disengaging positions, respective, of the lever 22 as described below.

Figure 6:
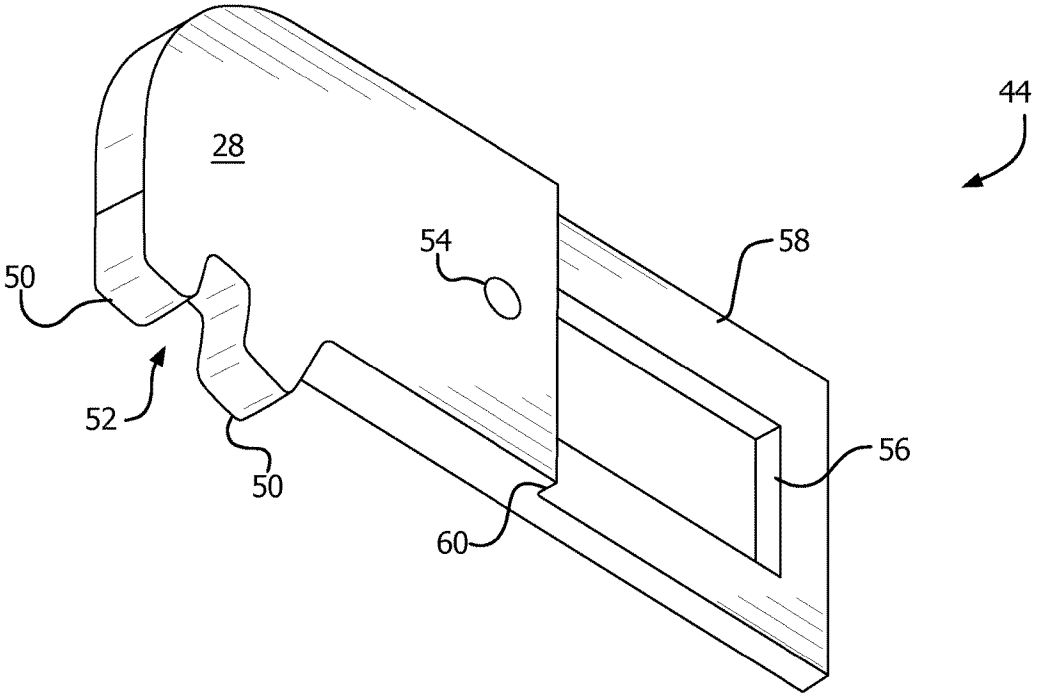
FIG. 6 is a perspective view of an inner arm component for a lever for a rotation device for a snowboard binding.
Figure 7:
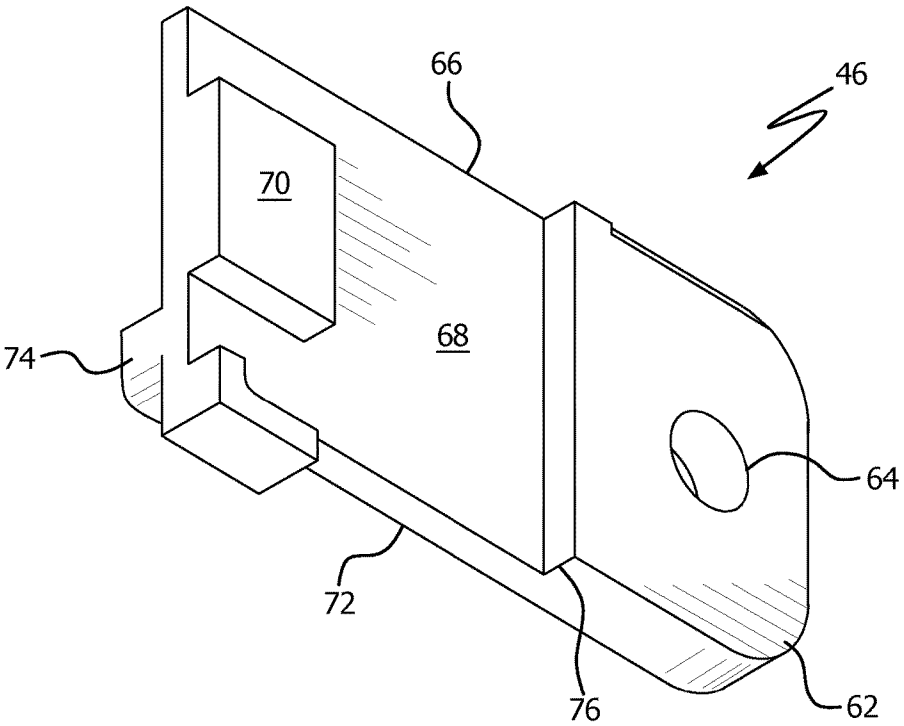
FIG. 7 is a perspective view of an outer arm component for a lever for a rotation device for a snowboard binding.

The lever 22 includes both an inner portion 44 (FIG. 6) and an outer portion 46 (FIG. 7). Referring to FIG. 6, the inner portion 44 includes a gear engaging end 28, which in the illustrated example includes a pair of teeth 50 that are dimensioned and configured to fit within the spaces 30 of the gear 16. A space 52, defined between the teeth 50, is dimensioned and configured to receive a tooth 18 of the gear 16. A pivot structure is also provided on the inner portion 44, which in the illustrated example is an aperture 54 that is generally centrally located on the inner portion 44, and which corresponds in size and shape to the aperture 36 of the base plate 20. A pin passing through the apertures 36, 54 will thus permit the lever 22 to pivot with respect to the base plate 20. A slot 56 is defined within the outer portion engagement section 58 of the inner portion 46. In the illustrated example, the outer portion engagement section 58 includes a beveled edge 60 adjacent to the aperture 54, so that the outer portion engagement section 58 has a thinner thickness than the remainder of the inner portion 44.

Referring to FIG. 7, the outer portion 46 is illustrated. The outer portion 46 includes an actuation end 62. In the illustrated example, the actuation end 62 includes a cord attachment structure defined therein. In the illustrated example, the cord attachment structure is in the form of the aperture 64. The outer portion 46 includes an inner portion engagement section 66, which includes a first face 68 having a projection 70 that is structured to fit within the slot 56. A second face 72 opposite the first face 68 includes a projection 74, with the projection 74 being structured to fit within the channel 38. In the illustrated example, the inner portion engaging section 66 terminates with a beveled edge 76, so that the inner portion engaging section 66 has a thinner thickness then the actuation end 62. When the inner portion 44 and outer portion 46 are brought together so that the projection 70 fits within a slot 56, the entire lever 22 of the illustrated example has a substantially uniform thickness.

Figure 8:
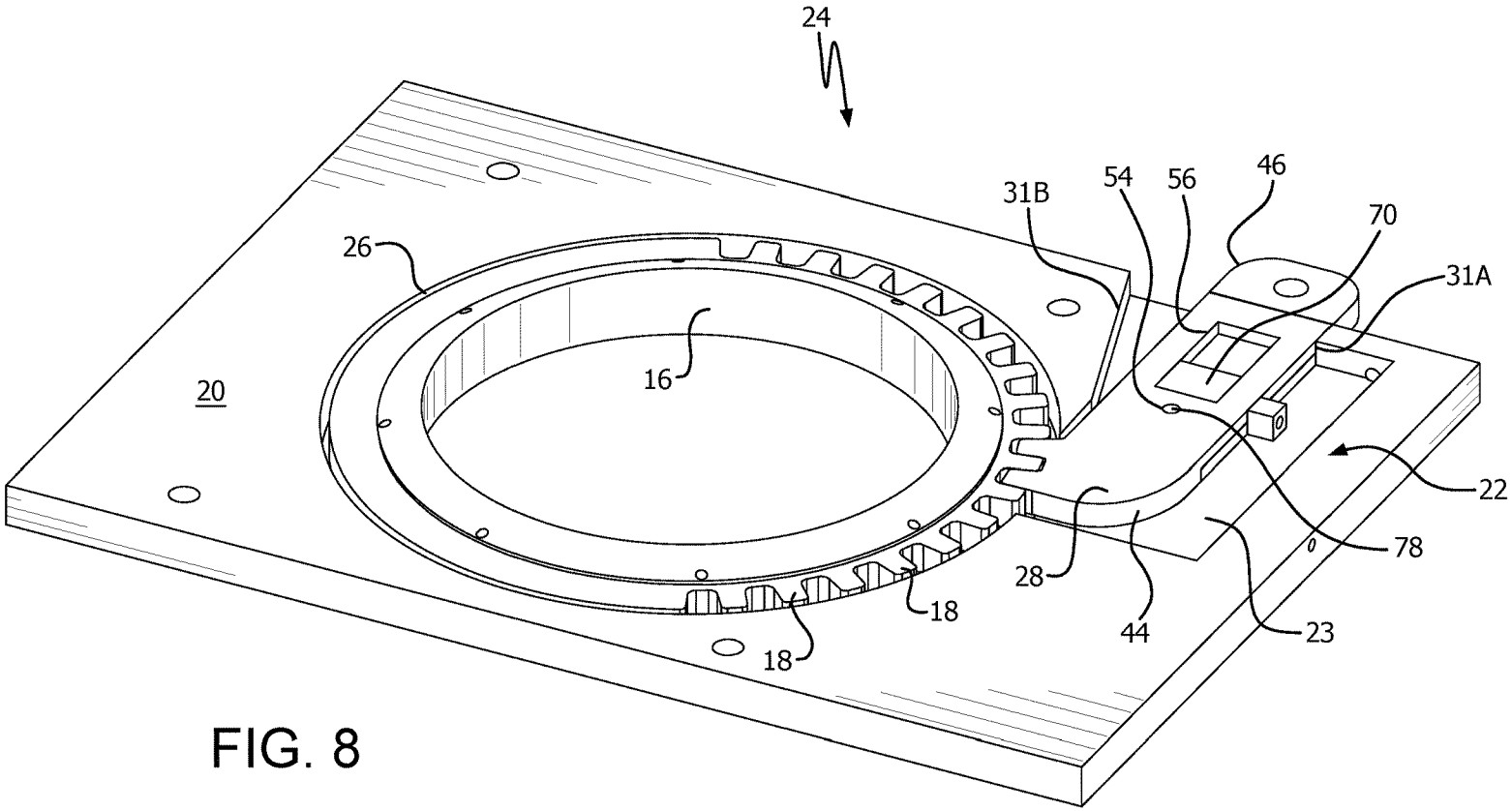
FIG. 8 is a perspective view of a rotation device for a snowboard binding, showing the outer arm component of the lever in its retracted position, and the lever engaged with the gear.

The assembled rotation device 24 is best illustrated in FIG. 8. A pin 78 passes through the apertures 36, 54 to pivotally secure the lever 22 to the base plate 20, with the projection 74 of the lever 22 fitting within the channel 38 defined on the base plate 20. Either the gear 16 or base plate 20 may be attached to either the binding mounting plate 12 or the snowboard 2. In the illustrated example, the gear 16 is attached to the binding mounting plate 12 and base plate 20 is attached to the snowboard 2, but it is equally possible for the gear 16 to be attached to the snowboard, and the base plate 20 to be attached to the binding mounting plate 12. As another alternative, the base plate 20 can be completely omitted, and the lever 22 and other features of the base plate 20 may be attached directly to either the snowboard or to the binding mounting plate 20, with the gear 16 attached to the other conventional snowboard component. With any of these mounting arrangements, the binding 10 is rotatably secured to the snowboard 2 in a manner that places the gear 16 within the generally circular cutout 26 within the binding mounting plate 20.

Figure 17:
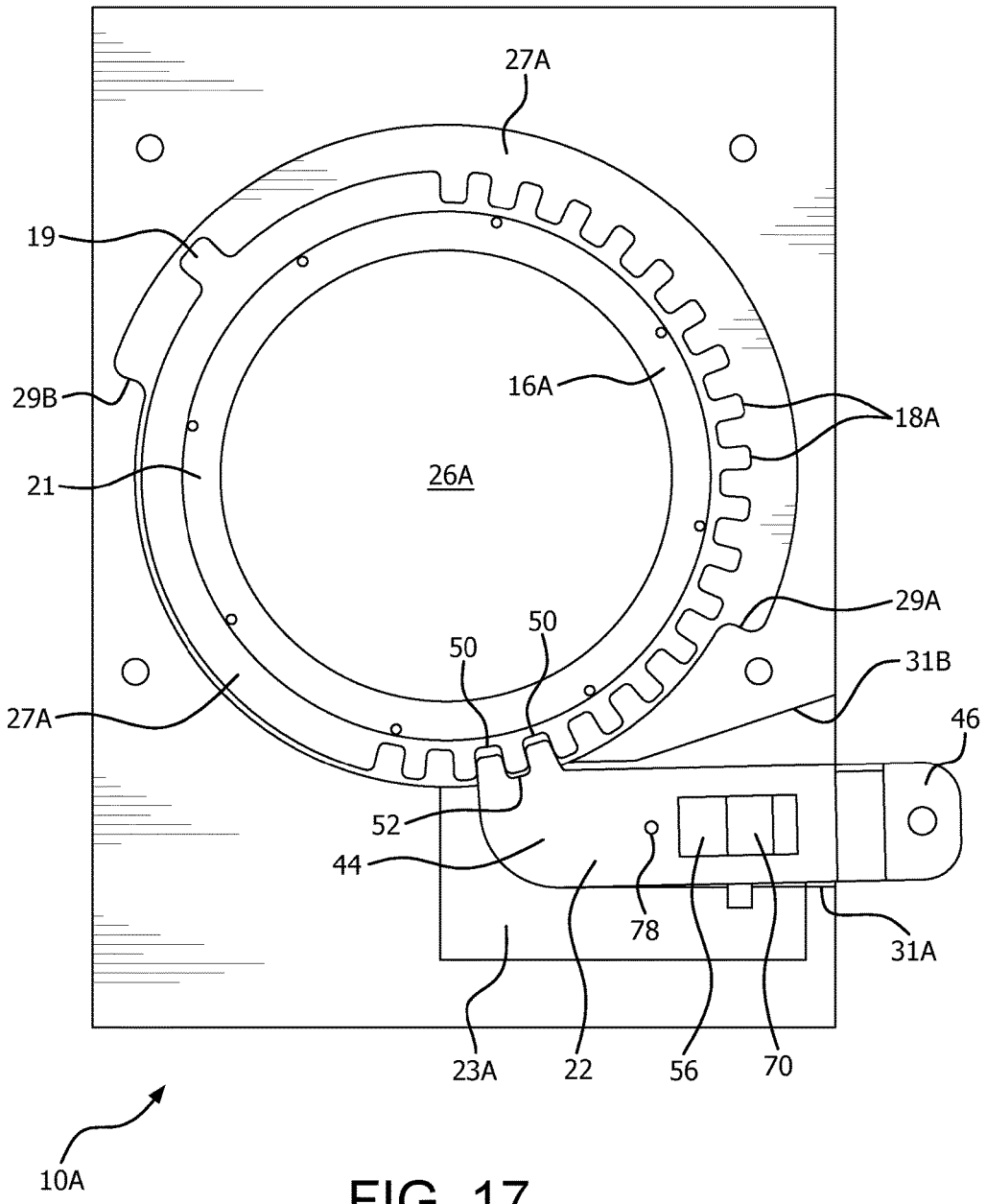
FIG. 17 is a top plan view of a rotation device for a snowboard binding, showing the outer arm component of the lever in its retracted position, and the lever engaged with the gear.
Figure 18:
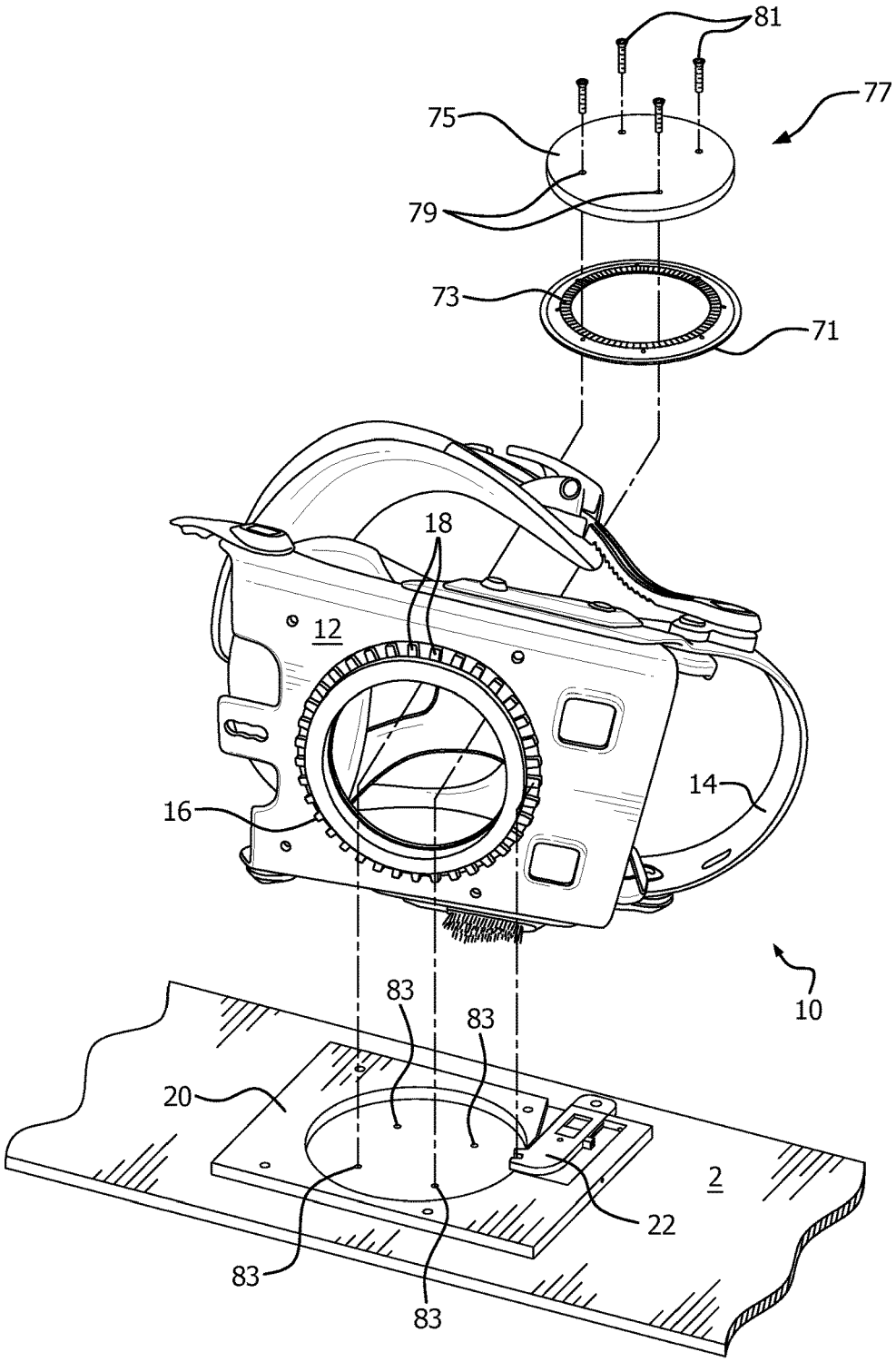
FIG. 18 is a partially exploded perspective view showing the rotation device in connection with a snowboard and a snowboard binding.

A modified rotation device 10A is illustrated in FIG. 17. This rotation device 10A utilizes a lever 22 as described above, along with a modified base plate 20A and modified gear 16A. The gear 16A includes teeth 18A disposed around about half of the outer periphery of the gear 16A. The gear 16A also includes a limit stop projection 19, which in the illustrated example projects outward from a portion 21 of the periphery of the gear 16A which does not include teeth 18A. Other examples may include a projection 19 extending in a different direction without deviating from the invention.

The base plate 20A includes a generally central cutout 26A for receiving the gear 16A. The base plate 20A also includes a cutout 27A corresponding to the projection 19 of the gear 16A. In the illustrated example, the cutout 27A forms a portion of the cutout 26A, extending around about the periphery of about half of the cutout 26A, and defining a limit 29A, 29B at each end. In the illustrated example, the cutout 27A does not extend completely through the base plate 20A. The base plate 20A also defines a cutout 23A for receiving a lever 22 as described above, including a limit 31A for limiting rotation of the lever 22 past its gear-engaging position, and a limit 31B for limiting rotation of the lever 22 past its gear-disengaging position. As before, the pin 78 provides a pivot point for the lever 22.

Figure 16:
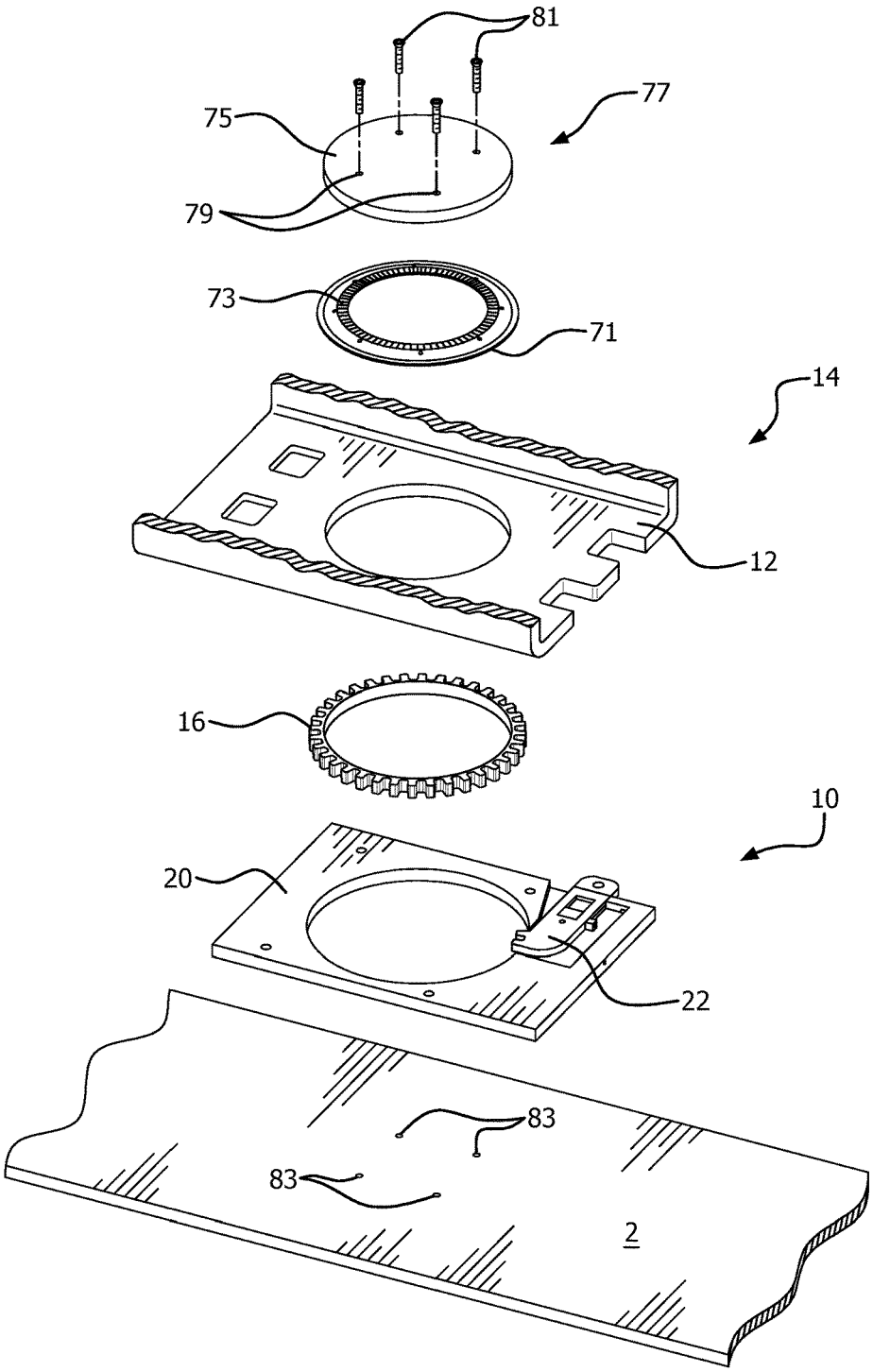
FIG. 16 is an exploded perspective view showing the rotation device in connection with a snowboard and a snowboard binding.

FIG. 16 illustrates the incorporation of the rotation device 10 into a binding 14 for a snowboard 2. In the absence of the rotation device 10, the binding 14 as used in the prior art would be secured to the snowboard using the ring 71 positioned on top of the binding mounting plate 12. The ring 71 includes generally upwardly and inwardly protruding teeth 73. A plate 75 is positioned on top of the ring 71. Those familiar with the art of snowboard bindings will recognize that the plate 75 has a lower surface 77 defining a plurality of teeth that interface with the teeth 73 of the ring 71. The plate 75 also defines a plurality of holes 79 for receiving screws 81 or other similar, conventional mounting hardware. The snowboard 2 defines a plurality of holes 83 for threadedly receiving the screws 81. In the absence of the rotation device 10, the ring 71 and plate 75 would be used to fixedly secure the binding 14 at a desired angle.

To provide rotatability to the binding 14, the rotation device 10 is provided between the binding mounting plate 12 and snowboard 2. In the illustrated example, the gear 16 is positioned below the binding mounting plate 12, and fastened to the ring 71 using pins passing through the gear 16 and ring 17, with the binding mounting plate 12 sandwiched therebetween. The base plate 20 is secured to the top surface of the snowboard 2. The plate 75 is placed on top of ring 71, and fastened to the snowboard 2 in the manner described above. With the rotation device 10 thus secured between the snowboard 2 and binding 14, the binding 14 can be rotated as described below.

Figure 10:
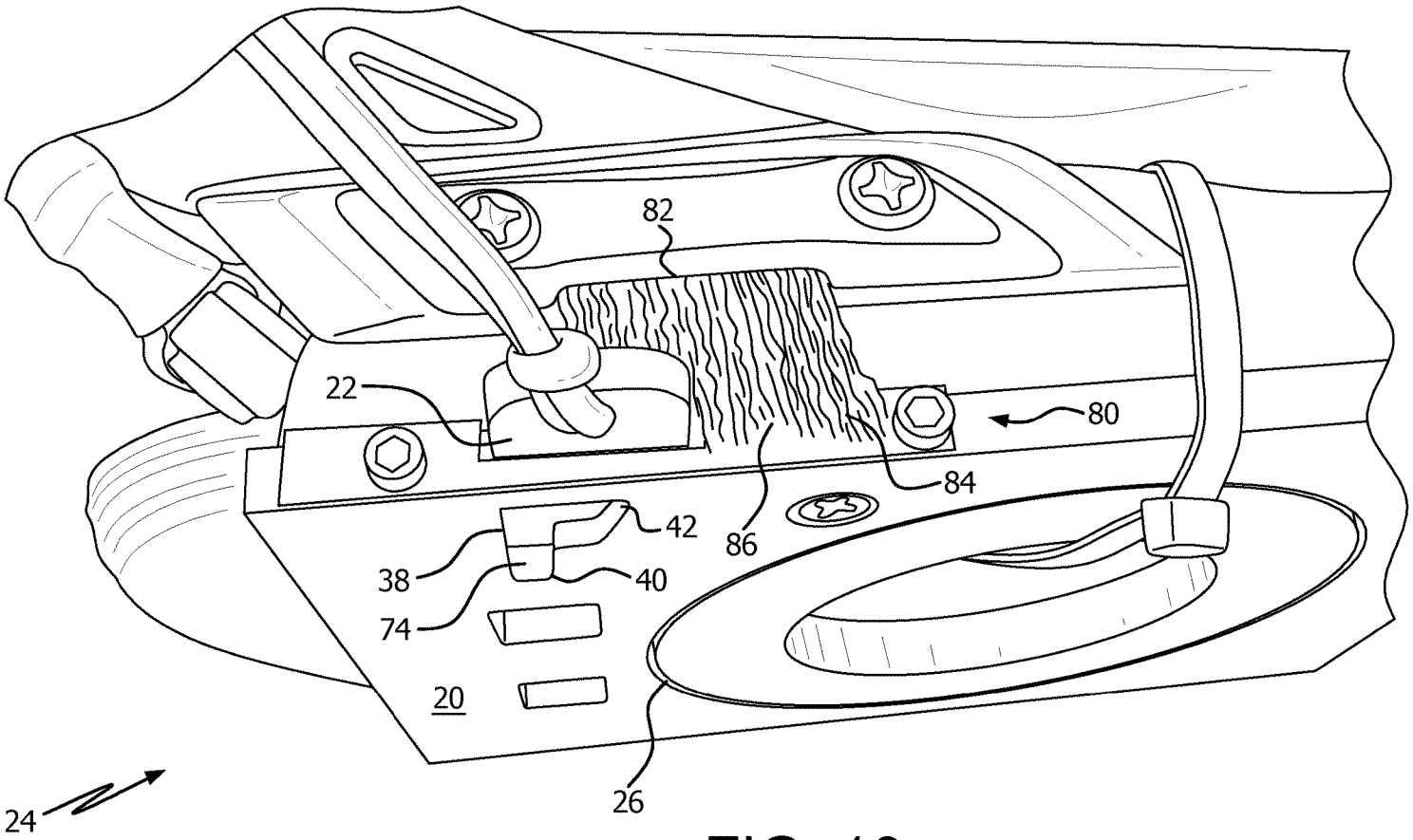
FIG. 10 is an environmental, perspective view of a rotation device for a snowboard binding, showing a brush that resists the entrance of snow into the device.

The gear 16 in the illustrated example is attached to the binding mounting plate 12. The gear 16 is disposed within the cutout 26, thereby bringing the teeth 18 into engagement with the gear engaging end 28 of the lever 22. When the gear engaging end 28 engages the teeth 18, rotation between the base plate 20 and binding mounting plate 12 is resisted. With the components as illustrated in FIGS. 8 and 10, the outer portion 46 of the lever 22 is in a retracted position, wherein the projection 70 is disposed at the end of the slot 56 closest to the aperture 54. With the outer portion 46 of the lever 22 in this position, the projection 74 fits within the generally rectangular portion 40 of the channel 38 defined within the base plate 20, thereby resisting pivoting of the lever 22.

Figure 9:
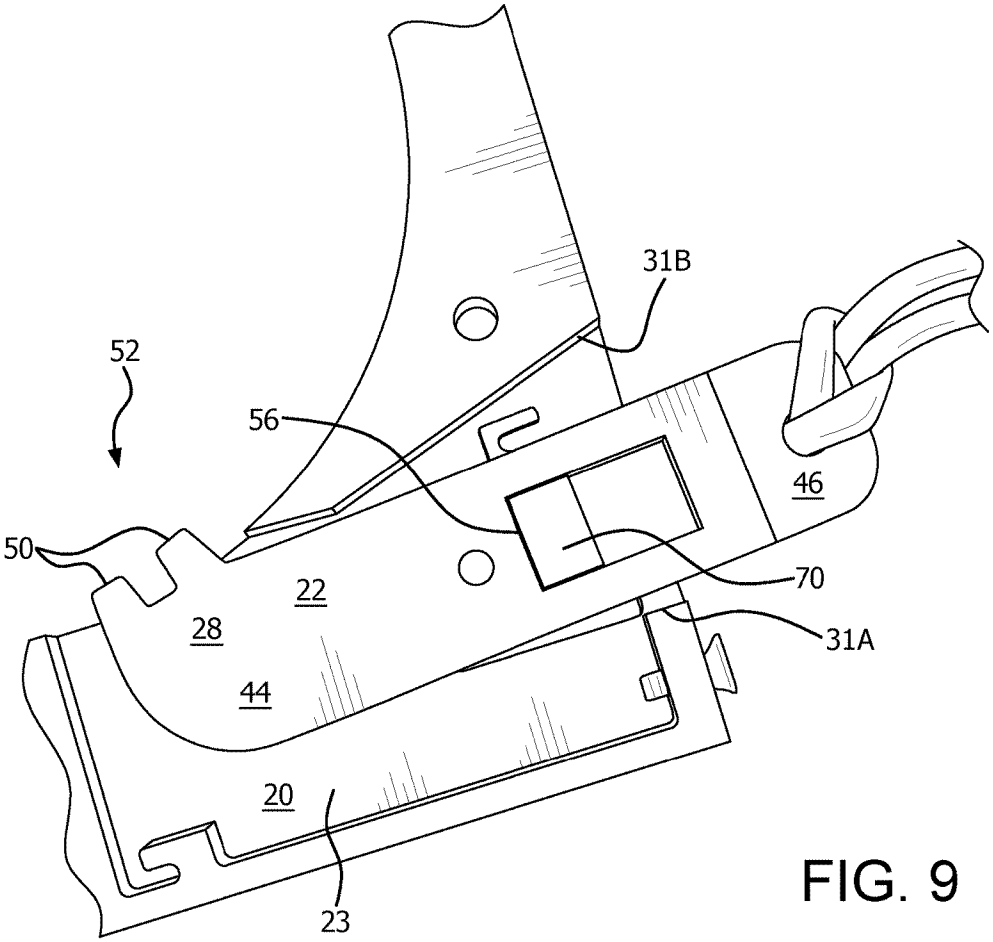
FIG. 9 is a top plan view of a lever for a rotation device for a snowboard binding, showing the outer arm component extended to permit rotation of the lever.
Figure 11:
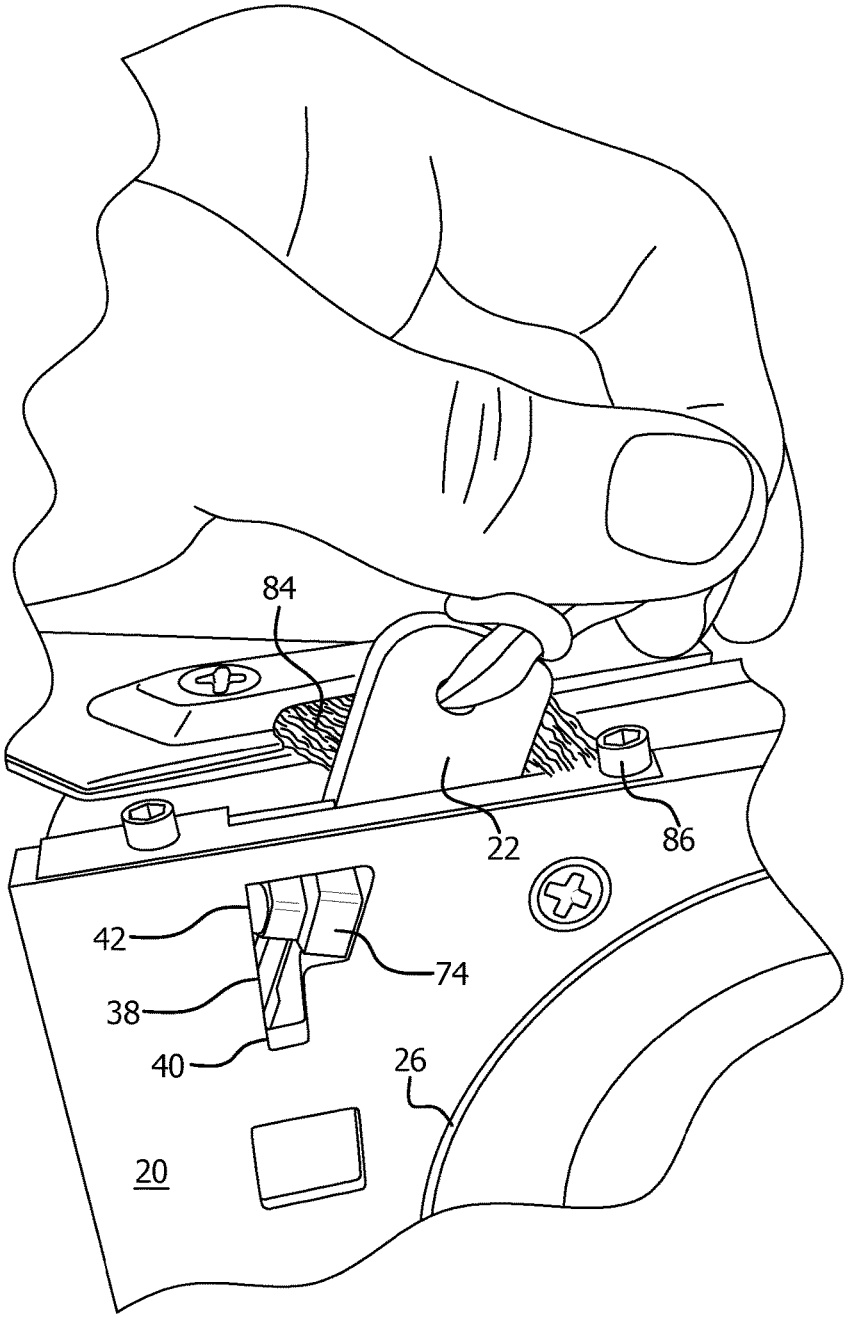
FIG. 11 is an environmental, perspective view of the rotation device of FIG. 9, showing the device being actuated to permit rotation.

As shown in FIGS. 9 and 11, the outer portion 46 of the lever 22 is now been extended with respect to the inner portion 44. The projection 70 has now moved to the opposite end of the slot 56, resisting further extension of the outer portion 46. The projection 74 has also moved into the larger, trapezoidal portion 42 of the channel 38, thereby permitting the pivoting of the lever 22 towards or away from the gear 16. By pivoting the lever 22 away from the gear 16, the binding 10 may be rotated with respect to the snowboard 2. Once the components have been rotated into a desired position, the gear engaging end 28 of the lever 22 can be moved back into engagement with the teeth 18 of the gear 16, thereby resisting rotation of the binding 10 with respect to the snowboard 2. Retracting the outer portion 46 with respect to the inner portion 44 of the lever 22 moves the projection 74 back to the rectangular portion 40 of the slot 38, thereby resisting pivoting of the lever 22 out of engagement with the gear 16.

In some examples, the outer portion 46 of the lever 22 may be biased towards its retracted position, in some examples by a spring.

Other means of providing for rotation between the gear 16 and base plate 20 may be provided. For example, the adjacent members that rotate with respect to each other could be a pair of disks (which need not be round) that include adjacent surfaces that are structured to frictionally engage each other, or to include ridges that engage each other, when the disks are pressed together, and to rotate with respect to each other when compression is removed, in a manner similar to a clutch arrangement. As another alternative, either of the two adjacent rotating members can include pins that fit within holes defined within the other rotating member when in the desired position with respect to each other, for example, the gear 16 can include pins, and the base plate 20 can include corresponding holes. When the two components are compressed together in a correct position, rotation is resisted. Otherwise, rotation is permitted.

Figure 12:
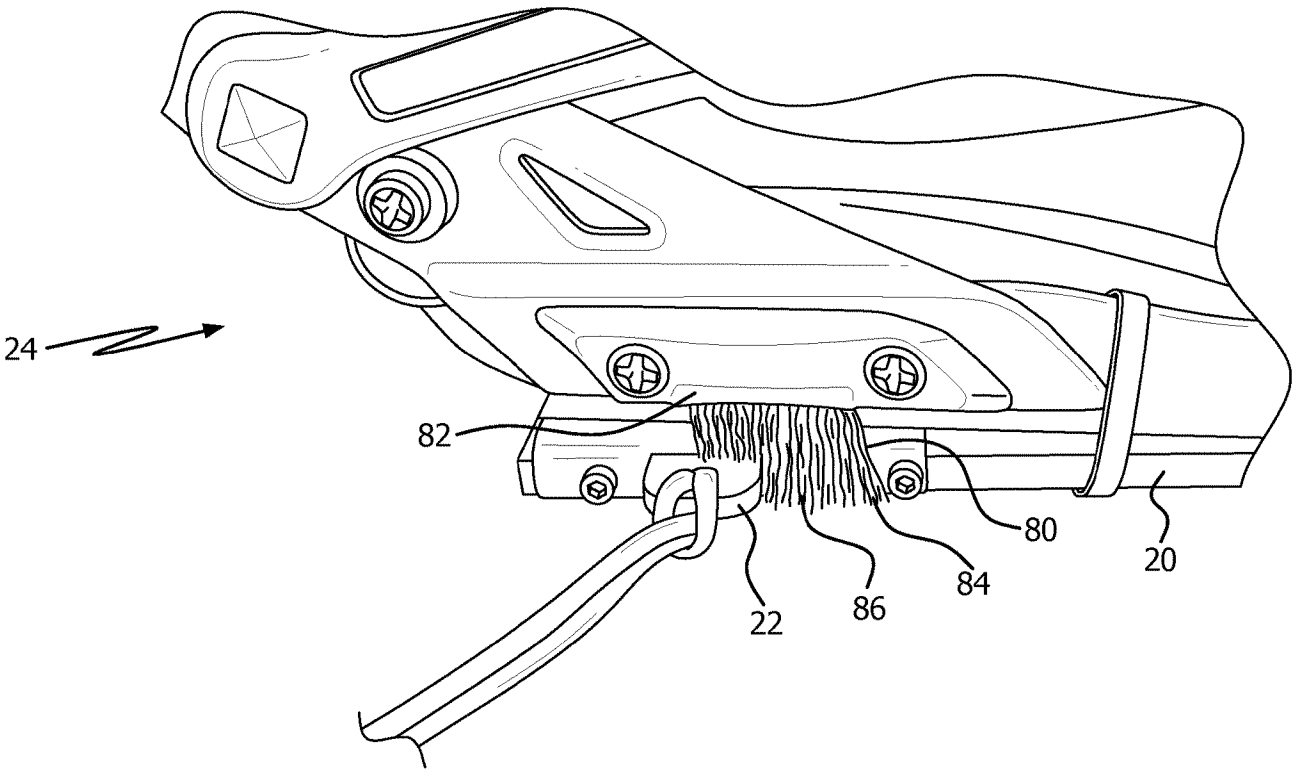
FIG. 12 is an environmental, perspective view of the rotation device of FIG. 9.

FIGS. 10-12 illustrate another example of the rotation device 24. The rotation device 24 as illustrated in these figures includes a brush 80 having a base 82 secured to the device 24, and bristles 84 having free ends 86 that abut the lever 22. The brush 80 resists the entrance of snow into the rotation device 24, thus resisting any potential for snow to interfere with the proper operation of the device 24.

The user of a snowboard will typically ride the snowboard with the user's feet generally perpendicular to the direction of the snowboard. Prior snowboard bindings are designed for use of the snowboard with the binding in this configuration. However, this position of the snowboard with respect to the user's feet makes walking awkward, and can cause the snowboard to bang the skis or feet of a person riding next to the snowboard user on a chair lift. The ability to rotate the binding with respect to the snowboard so that the user's foot is parallel to the snowboard when walking or riding a chair lift makes these activities easier and more convenient for the user. The present rotation device provides a means of rotating the binding with respect to the snowboard as desired by the user.

Figure 13:
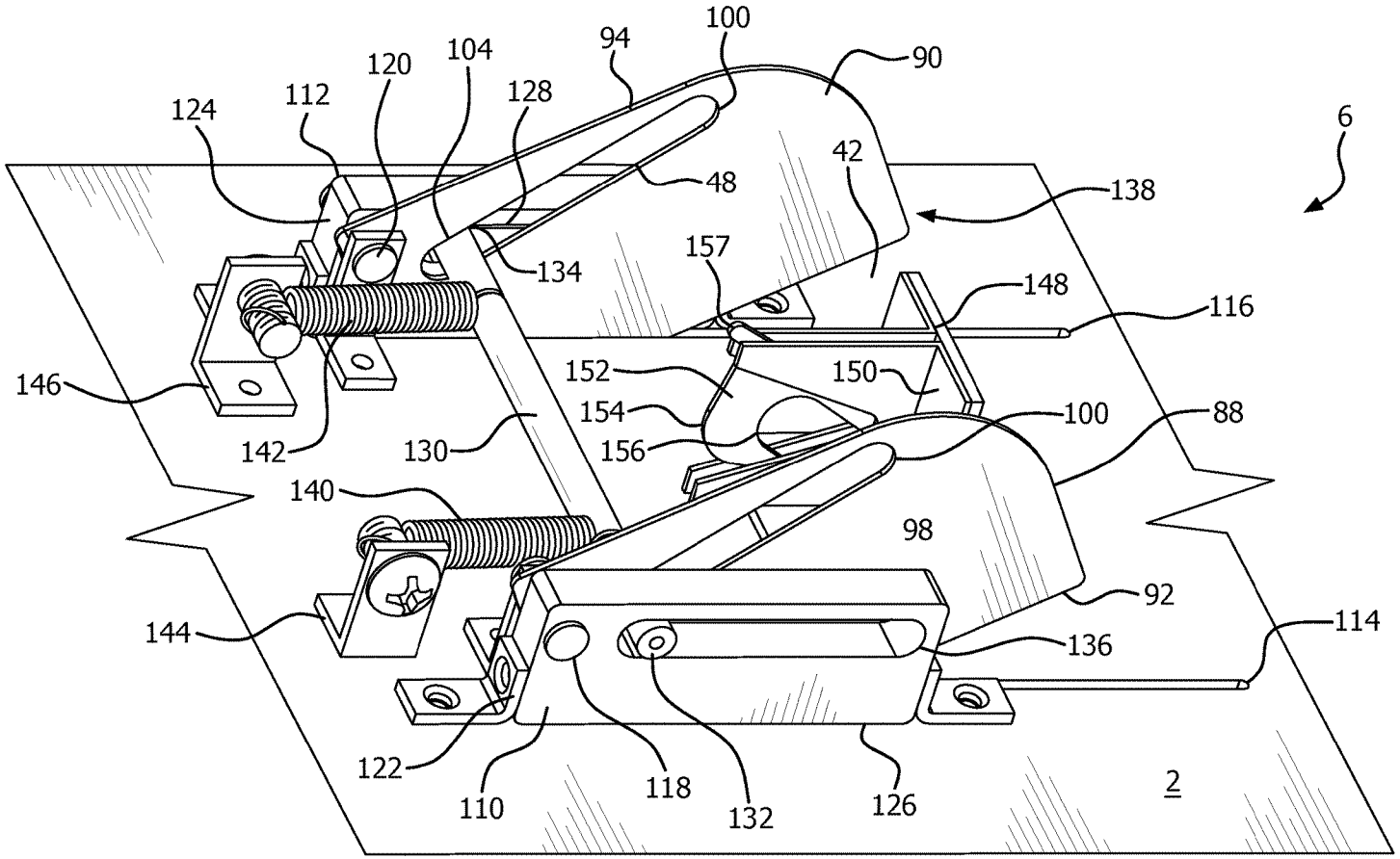
FIG. 13 is a perspective view of a retractable fin assembly for a snowboard, showing the fins retracted.
Figure 14:
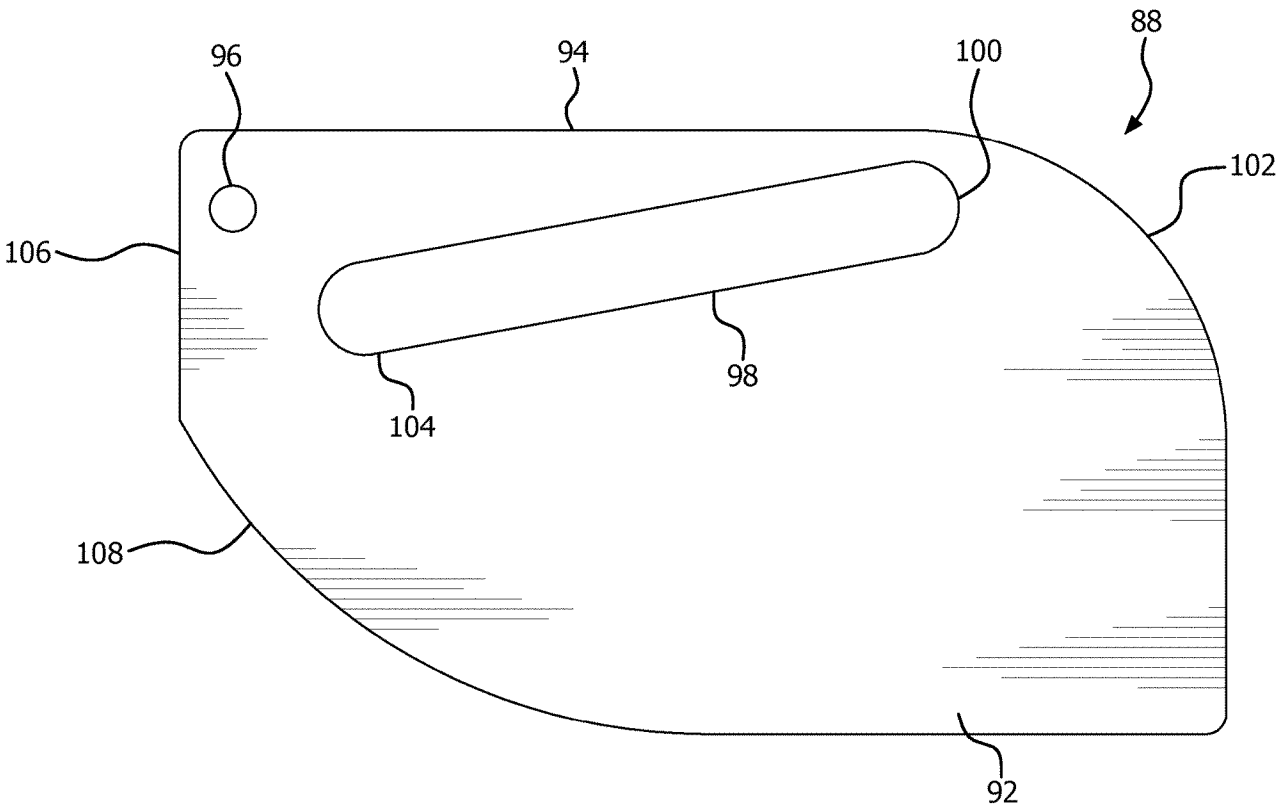
FIG. 14 is a side elevational view of a retractable fin for a snowboard.
Figure 15:
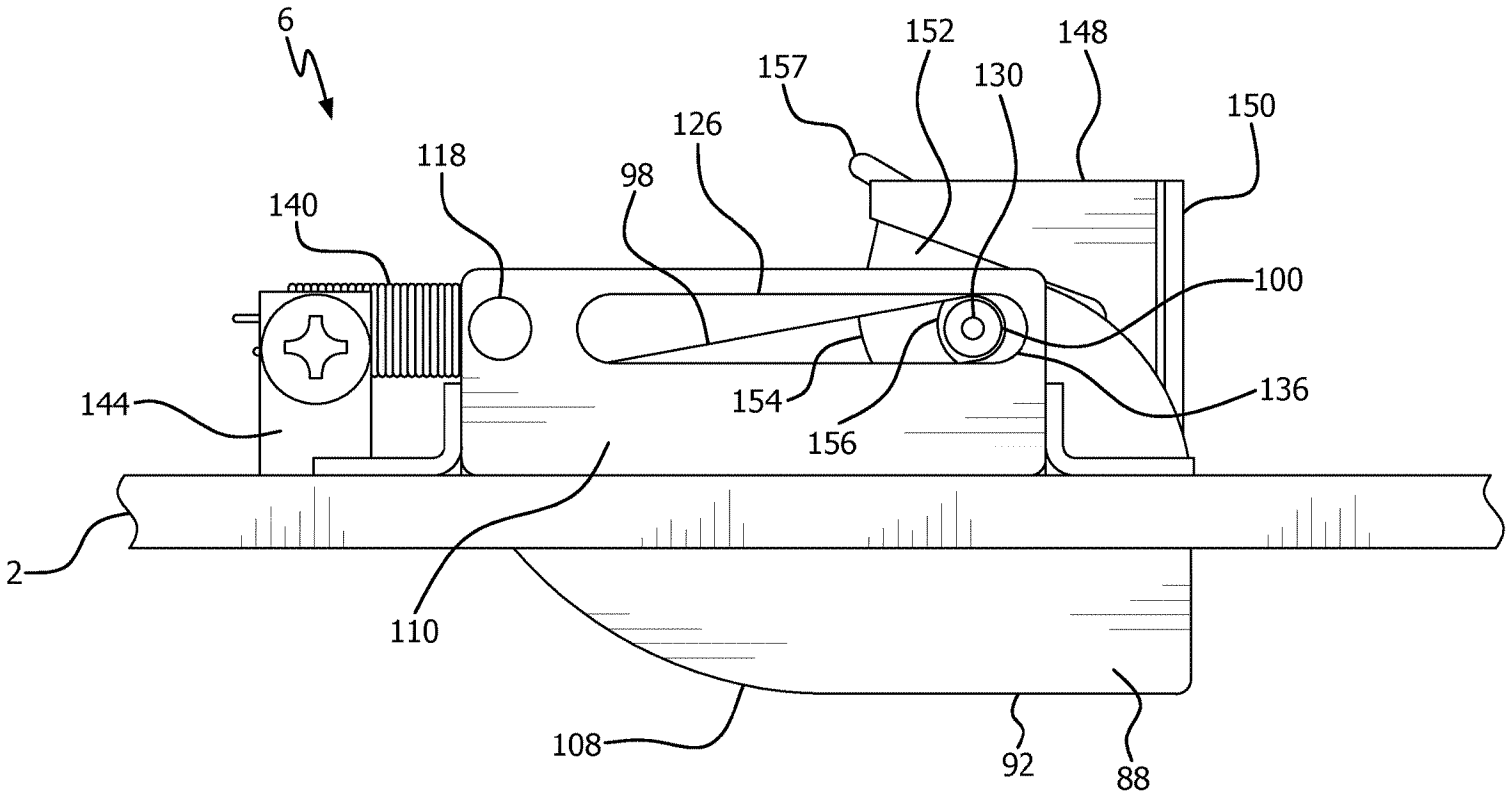
FIG. 15 is a side elevational view of a retractable fin assembly for a snowboard, showing the fins extended.

To assist with walking with the snowboard, some examples may provide a retractable fin assembly 6, which is best illustrated in FIGS. 13-15. Referring to FIGS. 13-14, the retractable fin assembly 6 includes at least one fin 88, with the illustrated example having a pair of fins 88, 90. As shown in FIG. 14, the fin 88 (of which is substantially identical to the fin 90) includes a lower edge 92 and an upper edge 94. An aperture 96 is defined adjacent to the end 106 of the upper edge 94, for pivotally securing the fin 88 as described below. A slot 98 is defined within an upper portion of the fin 88. The slot 98 is angled upward from horizontal, with the upper end 100 of the slot 98 being disposed adjacent to the end 102 of the fin 88, and the lower end 104 of those slot 98 being disposed adjacent to the end 106 of the fin 88, as well as being adjacent to the pivot aperture 96. The bottom edge 92 includes a curved portion 108 connecting the bottom edge 92 to the side 106, which, as explained below, facilitates complete retraction of the fin 88 when the retractable fin assembly is in its retracted configuration.

Referring back to FIG. 13, the retractable fin assembly six includes a mounting block 110, 112 associated with each of the fins 88, 90, respectively. Each of the mounting blocks 110, 112 is mounted to the snowboard two. A slot 114, 116 is defined adjacent to each mounting block 110, 112, with the fins 88, 90 being at least partially disposed within the slots 114, 116, respectively. The blade 88, 90 are pivotally secured to the mounting blocks 110, 112, respectively, by the pivots 118, 120 disposed adjacent to a first and 122, 124 of the mounting blocks 118, 120, respectively. Each of the mounting blocks 110, 112 also defines a generally horizontal slot 126, 128 that generally corresponds to the slot 98 defined within each of the blade 88, 90. A rod 130 extends through both of the slots 98 as well as the slots 126, 128. When the rod 130 is at the ends 132, 134 of the slots 126, 128, the rod is also at the ends 104 of the slots 98, thus securing the fins 88, 90 in a retracted position as shown in FIG. 13. Moving the rod 130 to the opposite ends 136 138 of the slots 126, 128 causes the bar 130 to move towards the end 100 of the slots 98, pushing the fins 88, 92 there extended position of FIG. 15.

In the illustrated example of the retractable fin assembly six, the rod 130 is biased towards the ends 132, 134 of the slots 126, 128 by at least one spring. In the illustrated example, a pair of springs 140, 142 extends between the rod 130 and a pair of brackets 144, 146, respectively, each of which is secured to the snowboard 2. A latch 148 includes a base 150 that is secured to the snowboard 2, and a curved arm 152 pivotally secured to the base 150. The curved arm 152 defines an outwardly facing convex surface 154 and an inwardly facing concave surface 156. The curved arm also includes an upward projection 157 to facilitate raising the arm 152 as described below. When the rod 130 is pulled towards the latch 148, the rod striking the convex surface 154 causes the arm 152 to pivot away from the snowboard 2, permitting the rod 130 to pass under the arm 152 and into the latch 148. The arm 152 is then lowered by gravity, and the concave surface 156 retains the rod 130 within the latch 148, thus retaining the fins 88, 90 in their extended position of FIG. 15 until the arm 152 is raised. Raising the arm 152 permits the springs 140, 142 to pull the rod 130 away from the latch 148, retracting the fins 88, 90 to the position of FIG. 13.

When the user is riding a ski lift with the snowboard, the user can have the forward binding attached to their boot and have the board rotated so that it is oriented forward and backward rather than sideways, where the board will not strike the skis of other ski lift riders. Upon exiting the ski lift, the user can extend the fins to facilitate walking with the snowboard. Once the user reaches the top of a slope, the user can retract the fins, rotate the rotatable binding into a conventional snowboarding position, strap their other foot into the conventional binding, and proceed down the slope. Upon reaching the bottom of the slope, the user can unstrap the conventional binding, rotate the rotating binding, extend the fins, and easily walk with the board.

Although the illustrated example utilizes a pivoting fin, those skilled in the art will realize that minor modification of the above-described retractable fins could result in a linearly moving retractable fin.

A variety of modifications to the above-described embodiments will be apparent to those skilled in the art from this disclosure. For example, the base plate 20 may be eliminated, with the binding secured directly to the remainder of the invention. As another example, the features of the base plate 20 could be provided directly on a snowboard with which the binding is used. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A rotatable binding assembly for a binding for a sliding recreational device, the sliding recreational device having a top surface, the binding having a base defining a bottom surface, the rotatable binding assembly comprising:

a gear having a periphery, the gear defining a plurality of teeth about at least a portion of the periphery, the teeth defining spaces therebetween, the gear being secured to one of the top surface of the recreational device or the bottom surface of the base;

a gear engagement member movably secured to the other of the top surface of the recreational device or the bottom surface of the base, the gear engagement member defining a gear engaging end having at least one tooth, the gear engagement member being movable between a first position wherein the at least one tooth of the gear engaging end interfaces with the teeth of the gear, and a second position wherein the gear engaging end is separated from the gear, the other of the top surface of the recreational device or the bottom surface of the base defining a channel having a first portion and a second portion, the first portion being smaller than the second portion; and an actuation member movably secured to the gear engagement member, the actuation member having a projection extending into the channel, the actuation member being movable between a first position wherein the projection is disposed within the first portion of the channel, and a second position wherein the projection is disposed within the second portion of the channel, the channel and the projection of the actuation member resisting rotation of the gear engagement member when the projection of the actuation member is within the first portion of the channel and permitting rotation of the gear engagement member when the first portion of the channel and to permit rotation of the gear disk engagement member when the projection of the actuation member is within the second portion of the channel;

whereby the binding may be rotated by moving the actuation member from the first position of the actuation member to the second position of the actuation member to permit movement of the gear engagement member, moving the gear engagement member from the first position of the gear engagement member to the second position of the gear engagement member, rotating the binding, moving the gear engagement member from the second position of the gear engagement member to the first position of the gear engagement member, and moving the actuation member from the second position of the actuation member to the first position of the actuation member.

2. The rotatable binding assembly according to claim 1, wherein the sliding recreational device is a snowboard.

3. The rotatable binding assembly according to claim 1, wherein the gear engagement member is a lever that is pivotally secured to either the top surface of the recreational device or the bottom surface of the base.

4. The rotatable binding assembly according to claim 3, wherein the actuation member is slidably mounted on the gear engagement member.

5. The rotatable binding assembly according to claim 1, wherein the first portion of the channel is generally rectangular, and the second portion of the channel is generally trapezoidal.

6. The rotatable binding assembly according to claim 1, further comprising a brush, the brush having bristles in contact with the actuation member.

* * * * *